US007692665B2

(12) United States Patent
Daly et al.

(10) Patent No.: US 7,692,665 B2
(45) Date of Patent: Apr. 6, 2010

(54) METHODS AND SYSTEMS FOR ADAPTIVE DITHER PATTERN APPLICATION

(75) Inventors: Scott J. Daly, Kalama, WA (US); Xiao-fan Feng, Camas, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 690 days.

(21) Appl. No.: 11/424,300

(22) Filed: Jun. 15, 2006

(65) Prior Publication Data

US 2006/0221401 A1 Oct. 5, 2006

Related U.S. Application Data

(62) Division of application No. 10/775,012, filed on Feb. 9, 2004, now Pat. No. 7,098,927.

(51) Int. Cl.
*G09G 5/02* (2006.01)

(52) U.S. Cl. ..... 345/596; 345/598; 345/599

(58) Field of Classification Search ..... 345/596–599; 358/3.13, 3.14; 382/260; 348/294, 607
See application file for complete search history.

(56) References Cited

U.S. PATENT DOCUMENTS 4,460,924 A 7/1984 Lippel
4,568,966 A 2/1986 Lippel
4,652,905 A 3/1987 Lippel
4,675,532 A 6/1987 Carson
4,758,893 A 7/1988 Lippel
4,965,668 A 10/1990 Abt et al.
5,148,273 A 9/1992 Lippel
5,253,045 A 10/1993 Lippel
5,254,982 A 10/1993 Feigenblatt et al.
5,619,228 A 4/1997 Doherty
5,623,281 A 4/1997 Markandey et al.
5,652,624 A 7/1997 Lippel
5,712,657 A 1/1998 Eglit et al.
5,714,974 A 2/1998 Liu
5,726,718 A 3/1998 Doherty et al.
5,751,379 A 5/1998 Markandy et al.
5,909,516 A 6/1999 Lubin
5,969,710 A 10/1999 Doherty et al.
6,040,876 A 3/2000 Pettitt et al.
6,052,491 A 4/2000 Clatanoff et al.
6,084,560 A 7/2000 Miyamoto
6,094,187 A 7/2000 Jones et al.
6,108,122 A 8/2000 Ulrich et al.
6,147,671 A 11/2000 Agarwal
6,147,792 A 11/2000 Jones et al.
6,215,913 B1 4/2001 Clatanoff et al.
6,281,942 B1 8/2001 Wang
6,476,824 B1 11/2002 Suzuki et al.
6,507,018 B2 * 1/2003 Young ..... 250/252.1

FOREIGN PATENT DOCUMENTS

EP 0656616 A1 7/1995

* cited by examiner

*Primary Examiner*—Hau H Nguyen
(74) *Attorney, Agent, or Firm*—Krieger Intellectual Property, Inc.; Scott C. Krieger

(57) ABSTRACT

Embodiments of the present invention comprise methods and systems for adaptive dither pattern array generation and application.

9 Claims, 8 Drawing Sheets

METHODS AND SYSTEMS FOR ADAPTIVE DITHER PATTERN APPLICATION

RELATED REFERENCES

This application is a divisional of U.S. patent application Ser. No. 10/775,012 entitled, "Methods and Systems for Adaptive Dither Structures", invented by Scott J. Daly and Xiao-fan Feng and filed on Feb. 9, 2004 now U.S. Pat. No. 7,098,927.

BACKGROUND OF THE INVENTION

Digital images are communicated by values that represent the luminance and chromatic attributes of an image at an array of locations throughout the image. Each value is represented by a given number of bits. When bandwidth, storage and display requirements are not restrictive, sufficient bits are available that the image can be displayed with virtually uninhibited visual clarity and realistic color reproduction. However, when bit-depth is restricted, the gradations between adjacent luminance or color levels can become perceptible and even annoying to a human observer. This effect is apparent in contouring artifacts visible in images with low bit-depth. Contour lines appear in low frequency areas with slowly varying luminance where pixel values are forced to one side or the other of a coarse gradation step.

These contouring artifacts can be "broken up" by adding noise or other dither patterns to the image, generally before quantization or other bit-depth reduction. This noise or pattern addition forces a random, pseudo-random or other variation in pixel values that reduces the occurrence and visibility of contours. Typically, the image is perceived as more natural and pleasing to a human observer.

Some of these methods can be explained with reference to FIG. 1, which illustrates an image display system 1. In these systems, noise or dither patterns 16 can be added to 4 or otherwise combined with an image 2. The combined image is then quantized 6 to a lower bit-depth. The image may then be displayed directly or, as shown in FIG. 1, may be transmitted 8 to a receiver 10. After reception, the noise/dither 16 that was added to the image may be subtracted 12 or otherwise de-combined with the image to reduce the visible effect of the noise/dither on areas where contouring is not likely to occur. The image is then displayed 14 on the receiving end. These methods may also be used in systems that do not transmit or receive such as with displays with bit-depth capabilities that are lower than the image data 2 to be displayed.

Some of these methods may be explained with reference to FIG. 2. In these systems 20, an image 2 is combined 28 with a noise/dither pattern 16 and sent to a display system 22 that cannot display the full range of image data contained in the image. These display systems 22 may quantize 24 the image data to a bit-depth that matches the display capabilities. The quantized image data is then displayed on the display 26.

In the systems illustrated in FIG. 2, the noise/dither pattern is not subtracted or de-combined from the image. In these systems, less noise can be added to an image before it causes adverse visual impact or "graininess." Various frequency distributions for noise/dither patterns have been found to be more or less visible to the human visual system. Generally, the human visual system works as a low-pass filter that filters out high frequency data. Therefore, noise concentrated in a high-frequency range is less visible than lower frequency noise.

Often it is not feasible to use a dither/noise pattern that is as big as an image file. In these cases, a smaller dither pattern can be used by repeating the pattern across the image in rows and columns. This process is often referred to as tiling. In multiple image sets, such as the frames or fields of video images, a dither pattern may be repeated from frame to frame as well. Dither patterns may be designed to minimize artifacts created by their repetitive patterns.

Dither structures may comprise multiple dither patterns to be used across a single image of multiple frames. A three-dimensional dither structure, as shown in FIG. 3, may employ a series of dither patterns. These patterns 30-36 may be arranged in a sequence that is used on sequential frames of video. A first dither pattern tile 30 may be used on a first video frame 38 while a next sequential pattern 32 is used on a next successive video frame 40. The sequence of patterns 30-36 may be repeated after each pattern in the sequence is used. These sequences may also be specially designed to reduce the occurrence of artifacts from their repetitive temporal patterns.

DETAILED DESCRIPTION

Figure 1:
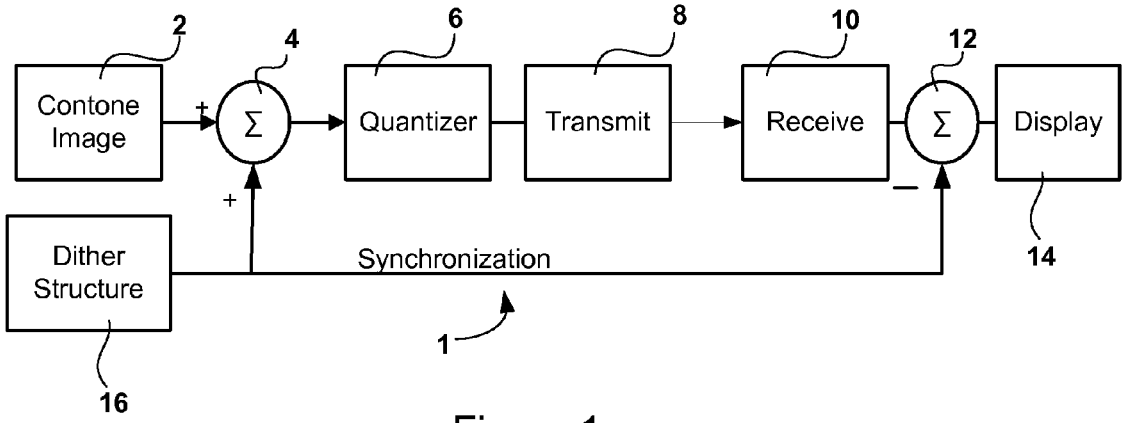
FIG. 1 shows a prior art display device.
Figure 2:
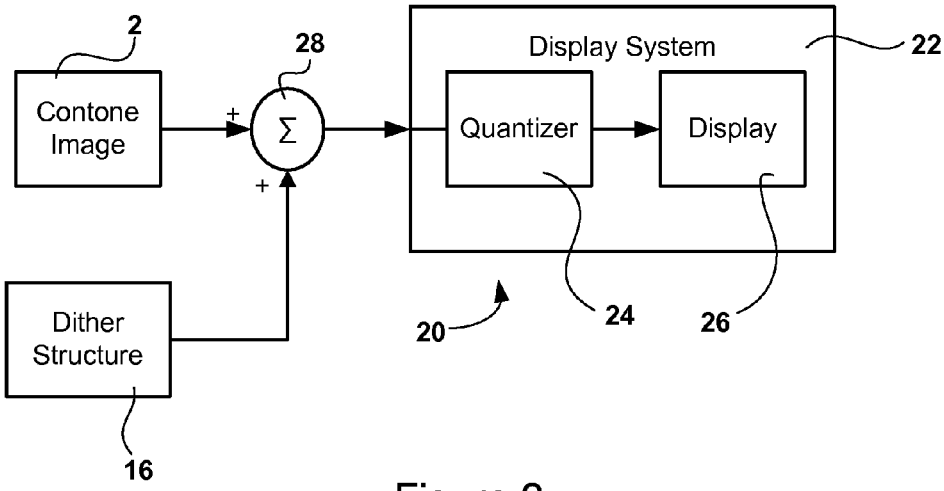
FIG. 2 shows another prior art display device.
Figure 3:
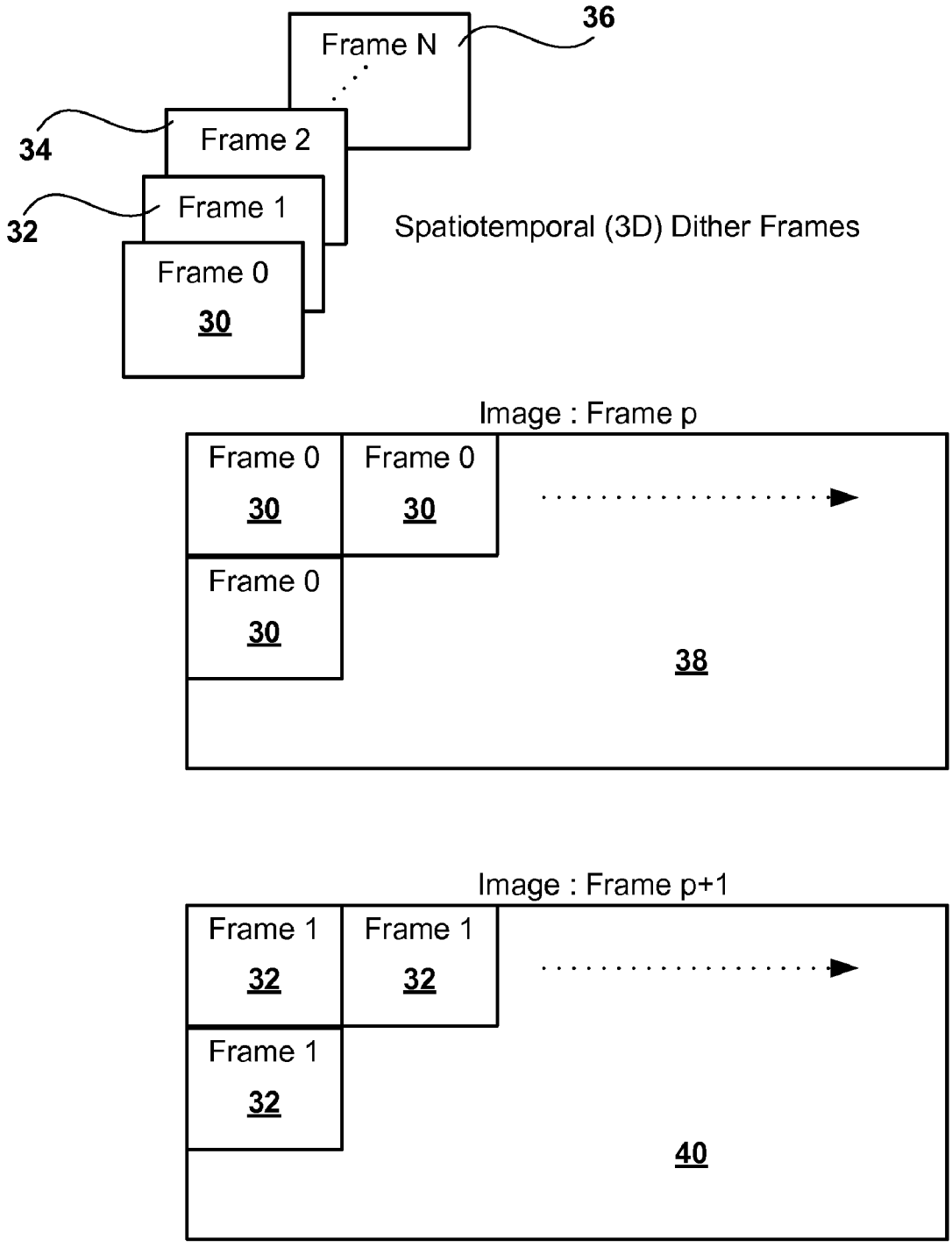
FIG. 3 shows a prior art dither structure as applied to image frames.

Referring in detail to the drawings wherein similar parts of the invention are identified by like reference numerals.

Methods and systems of embodiments of the present invention relate to display algorithms, processes and apparatus that use spatiotemporal dithering to cause a perceived bit-depth to increase. These methods and systems may be used for LCD or similar displays with a digital bit-depth bottleneck, such as graphics controller cards with limited video RAM (VRAM). Bit-depth limitations can also arise in the LCD display itself, or its internal hardware driver. In embodiments of the present invention, the temporal response characteristics of the display may be used to dynamically parameterize the dither pattern.

The overall problem is loss of image quality from having too few gray levels per color. It shows up as contouring and loss of information (in particular, loss of low amplitude signals). Embodiments of the present invention may be applied toward allowing 4 to 6 bits/color displays to show images that have an image quality visually equivalent to 8 bits/color. Another application is to make an 8-bit display have the quality of 10 bits, if a 10 bits or higher image is to be displayed.

The main problem with our current state of technology is that there remains a segment of the grayscale where it is difficult to remove contour artifacts without increasing the amplitude of the dither pattern (e.g. noise) so much that it becomes visible. This is due to the tonescale shape being close to a gamma power of 2.4 while the visual system nonlinearity is close to 1/3. The cascade of these two nonlinearities results in a steeper slope in the dark areas than the rest of the tonescale.

Figure 4:
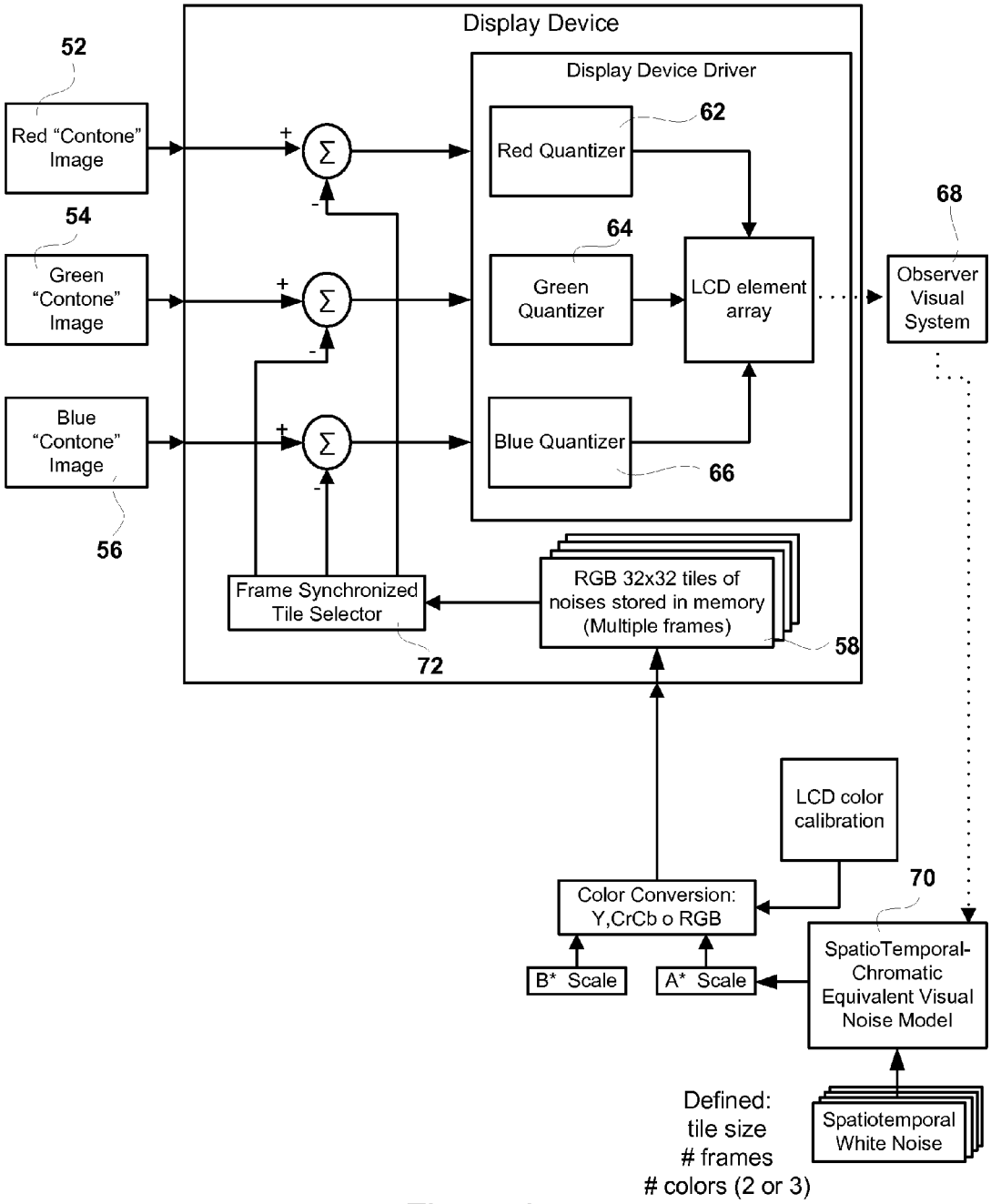
FIG. 4 shows a spatio-temporal dithering system.

Some attributes of embodiments of the present invention may be explained with reference to FIG. 4, which shows methods and systems for dither pattern creation by optimizing the pattern to the human visual system (HVS) characteristics (i.e., shaping its spatiotemporal chromatic power spectrum to match that of the equivalent noise of the visual system). In these embodiments, a color image with multiple color channels 52-56 is combined with a dither array prior to quantization 62-66. The dither array structure is created with reference to the human visual system 68 which is less sensitive to higher frequency noise. Accordingly, a spatio-temporal high-pass dither structure 70 is created in which both spatial dimensions and the temporal dimension have high-pass characteristics.

In embodiments of the present invention, the dither structure may also be optimized for display properties. In some of these embodiments, we can use the inherent fixed-pattern spatial noise of the display as a factor in dither pattern design.

For effective dither pattern design, the goal is to add as much noise as possible, yet make sure the noise is not visible in the displayed image. Embodiments of the present invention may take advantage of the visual system's LPF characteristics, by giving the dither structure a high-pass characteristic, so that the dither pattern on the display may be attenuated by the visual systems LPF, which is primarily due to optical characteristics. In other words, the equivalent input noise of the visual system (often modeled as the inverse of the frequency response of the visual system, the contrast sensitivity function (CSF), analogous to a frequency response) may be used to shape the dither pattern (noise).

Embodiments of the present invention may be used in conjunction with displays with the capability of displaying temporally changing signals. In these embodiments, it is worthwhile to use a spatio-temporal dither structure. The equivalent noise and resulting dither pattern are shown in iconic form in FIG. 5. Its power spectrum is mutually high pass in spatial and temporal frequencies. The digital frequency Nyquist limits are 0.5 (0.5 cycle/sample; sample=pixel or frame). The axes are horizontal spatial frequency (H SF) 80, vertical spatial frequency (V SF) 82, and temporal frequency (TF) 84.

Figure 5:
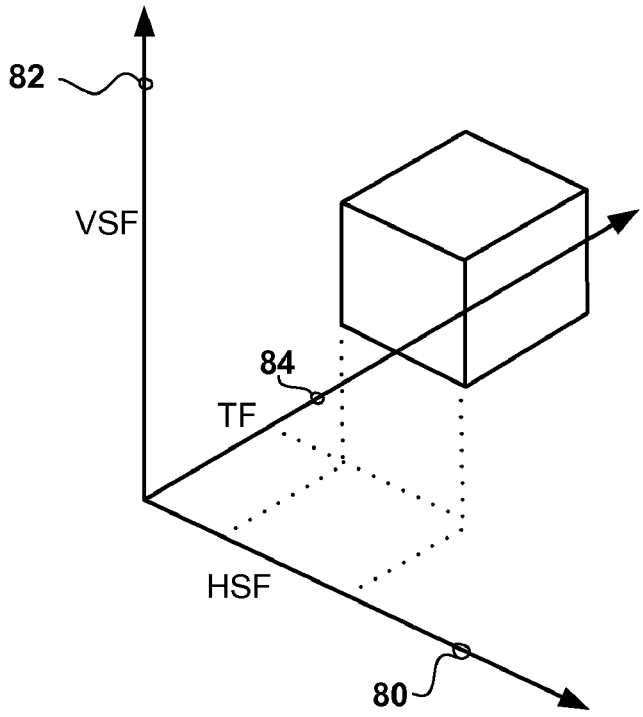
FIG. 5 shows an iconic representation of a mutually high-pass spatial and high-pass temporal dither spectrum.
Figure 6:
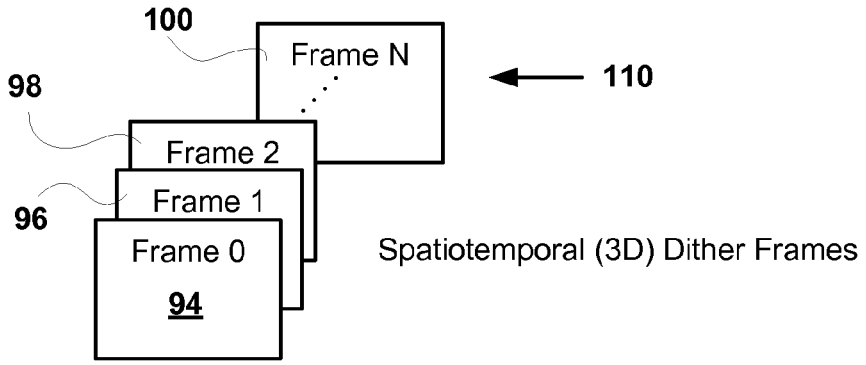
FIG. 6 shows a dither structure with tiles applied to image frames.
Figure 6:
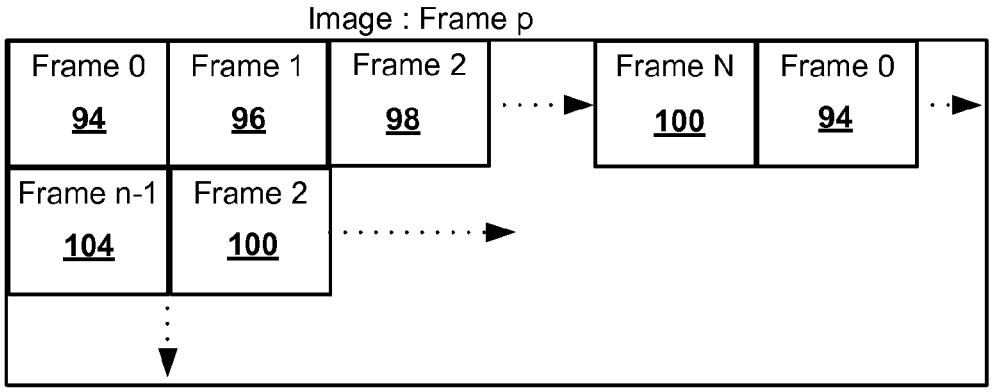
Figure 6:
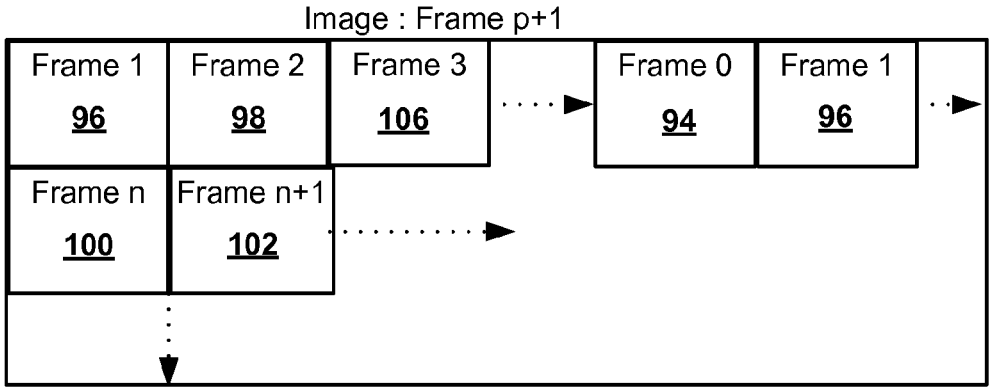

In these spatio-temporal embodiments, the dither array may be stored as a series of 2D tiles (or equivalently, as a 3D sequence), where the series consists of different sequential tiles intended for sequential frames of the real-time display. The behavior of the frame synchronized tile selector 72 as shown in FIG. 4 is shown in FIG. 6. FIG. 6 shows a spatio-temporal dither structure imposed on sequential image frames, frame "p" 90 and frame "p+1" 92. Imposed on the image frames are the tiles of the dither structure. At any one spatial position on the display we have a series of dither tiles added to the input image frame, and these tiles are stepped through sequentially to preserve the temporal power spectrum of their design (i.e. FIG. 5).

Some embodiments of the present invention may employ a tile stepping method as illustrated in FIG. 6 for further reduction of the possibility of visible artifacts. In these embodiments, a spatio-temporal array of dither pattern tiles 110 may be used. These dither pattern tiles 110 are typically smaller than the image to which they are applied in order to reduce memory size. The smaller tiles can cover the image in a tile pattern that uses the same tiles repeatedly. In some applications, the same tile may be used repeatedly across the image, however, this method can result in visible artifacts caused by the repeated pattern. This problem may be reduced or eliminated by using tiles from multiple successive frames. This method can be employed in the spatial and temporal dimensions.

As shown in FIG. 6, tiles can be incremented spatially across an image frame 90 starting with a first tile frame 94 and then using each successive tile frame 96, 98 & 100 to fill out the tile pattern across the image 90. This pattern of successive tile frames can be employed in the temporal direction as well. In the next successive image frame 92, the tile frame succeeding the tile frame used in the prior image frame at any given tile location is used. For example, when a first tile frame 94 is used in the top left position in a first image frame 90, the next successive tile frame 96 is used at that location in the next image frame 92. Similarly, the second tile position in the first frame 90 is occupied by the second tile frame 96 and that position in the second image frame 92 is occupied by the third tile frame 98. The same pattern is repeated for each tile position and each image frame. Once the number of tile frames is exhausted, the tile set order may be repeated.

In some applications, it may prove difficult to use the spatial characteristics of a display (other than the straightforward use of resolution in ppi and viewing distance in the mapping of the CSF to the digital frequency domain). This is because the use of the spatial display noise requires high-res 2D imaging of the display and because the use of the spatial modulation transfer function (MTF) may not have a significant impact since that MTF may be much better than the eye's limitations. Accordingly, in some applications, only the visual system limitations are used spatially.

Figure 7:
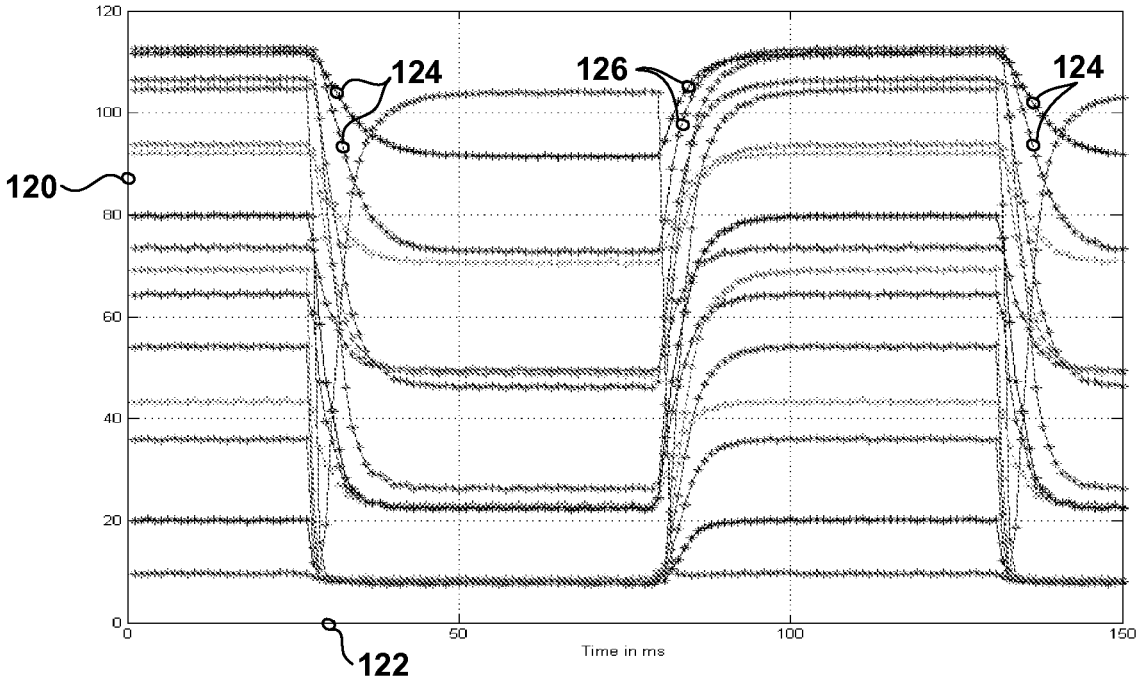
FIG. 7 is a graph showing temporal responses of an LCD display to different fray level transitions.

However, the display's temporal properties do allow for tuning the dithering array in that dimension. In FIG. 7, various recordings made of temporal edge transitions are shown for a particular "normally white" mode LCD. The vertical axis 120 is luminance in cd/m^2, and the horizontal axis 122 in ms. The stimulus is a square wave in time, so we can see both light to dark 124 and dark to light 126 transitions of different amplitudes. Notice how the responses are faster going toward the dark area, as well as within the dark areas.

Figure 8:
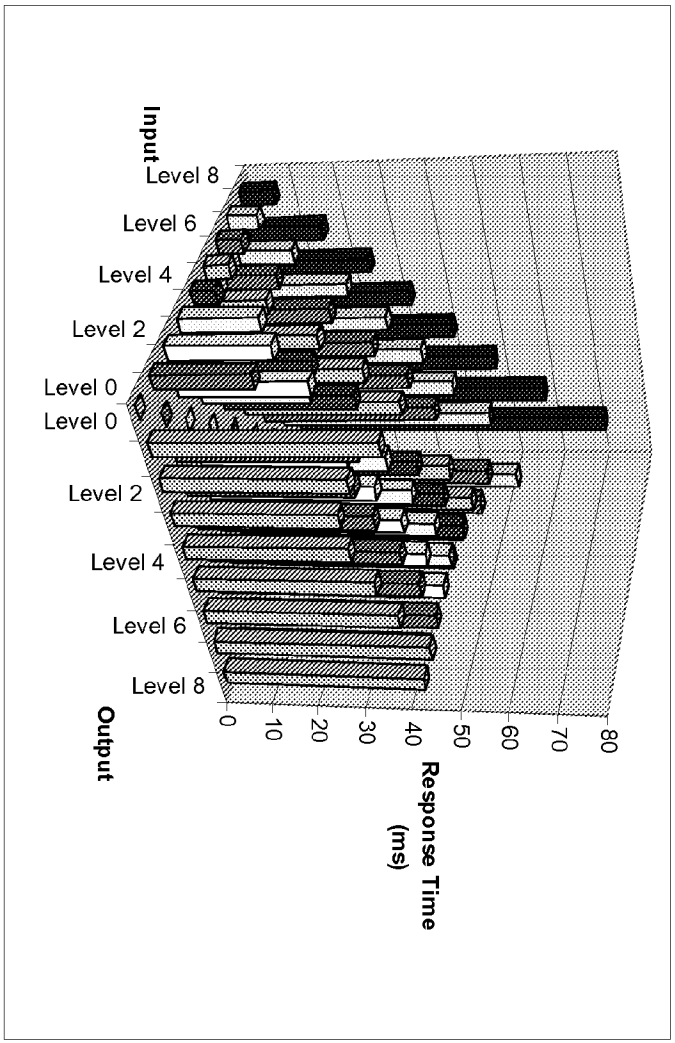
FIG. 8 is a graph showing transition times for a normally-white LCD.
Figure 9:
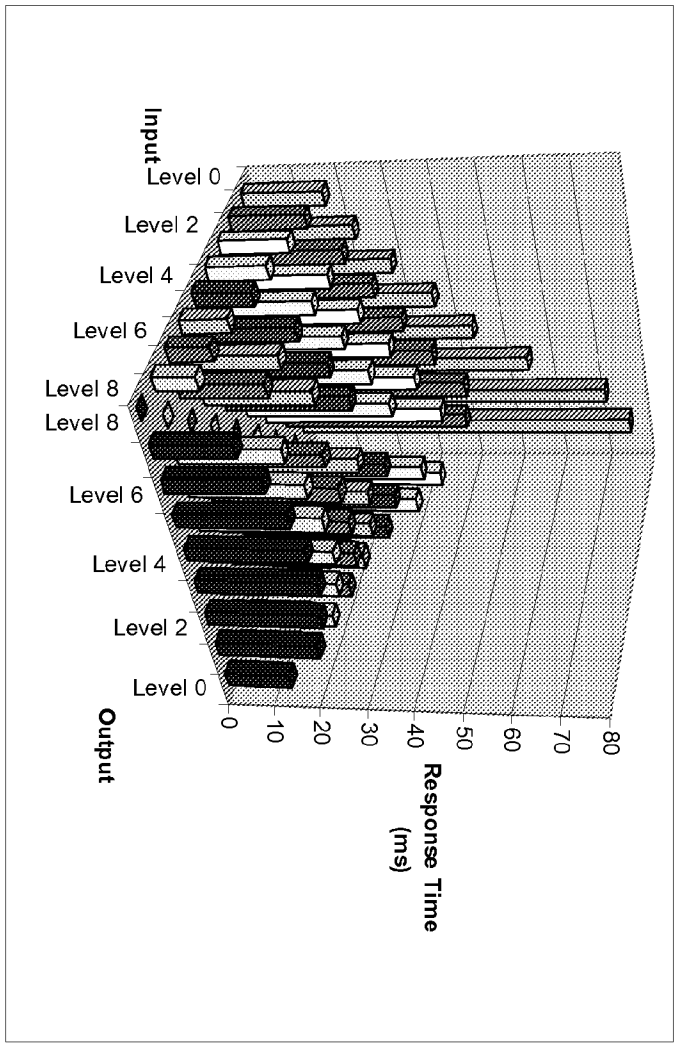
FIG. 9 is a graph showing transition times for a normally-black LCD.

Each response is typically summarized as a single number by measuring the time it takes to go from 10% to 90% of the luminance change. Such responses to dark to light and light to dark transitions of different amplitudes are shown in FIGS. 8 and 9 for two key types of LCDs (normally white and normally black, respectively).

The normally black mode has the slower responses in the dark regions of the tonescale and since that is where our difficult region is, we can use these slower responses to our advantage.

Figure 10:
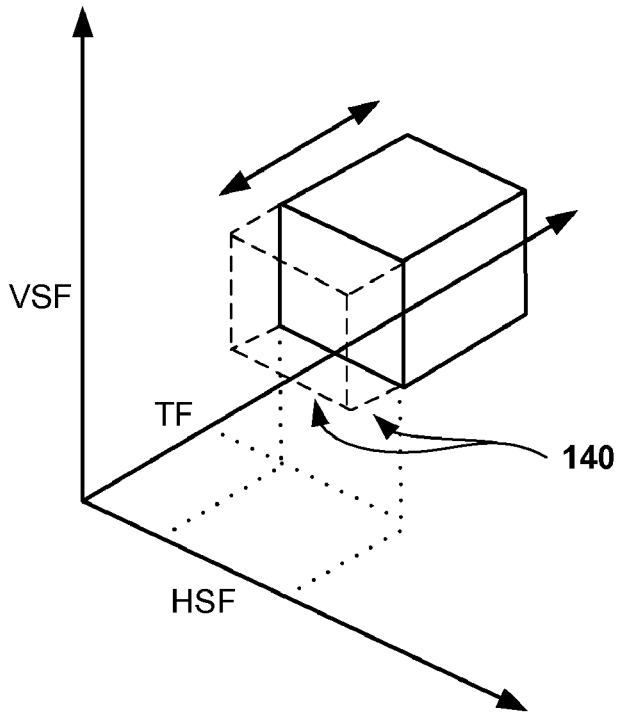
FIG. 10 is an iconic representation of a mutually high-pass spatial and high-pass temporal dither spectrum wherein the lower bound of the temporal frequency range is variable.

Some embodiments of the present invention use a spatiotemporal dithering pattern, having a mutually high-pass spatial and high-pass temporal spectrum, where the lower frequency cutoff varies with gray level. This spectrum is shown in FIG. 10, which can be compared to other embodiments with a fixed cutoff (FIG. 5). Of course, the block shown in FIG. 10 is iconic; the noise is not limited to having sharp cut-off frequencies and it could be better visualized as a Gaussian blob centered at these high frequencies. A key aspect of these embodiments is that the lower temporal frequency cutoff is variable (notated by the dashed lines).

In some embodiments, variance increases with the increase in volume of the iconic cube. The higher variance can allow for stronger reduction of contours, which in turn allow the bit depth to be reduced, or more complete removal of contour artifacts in the troublesome region of the tonescale.

Figure 11:
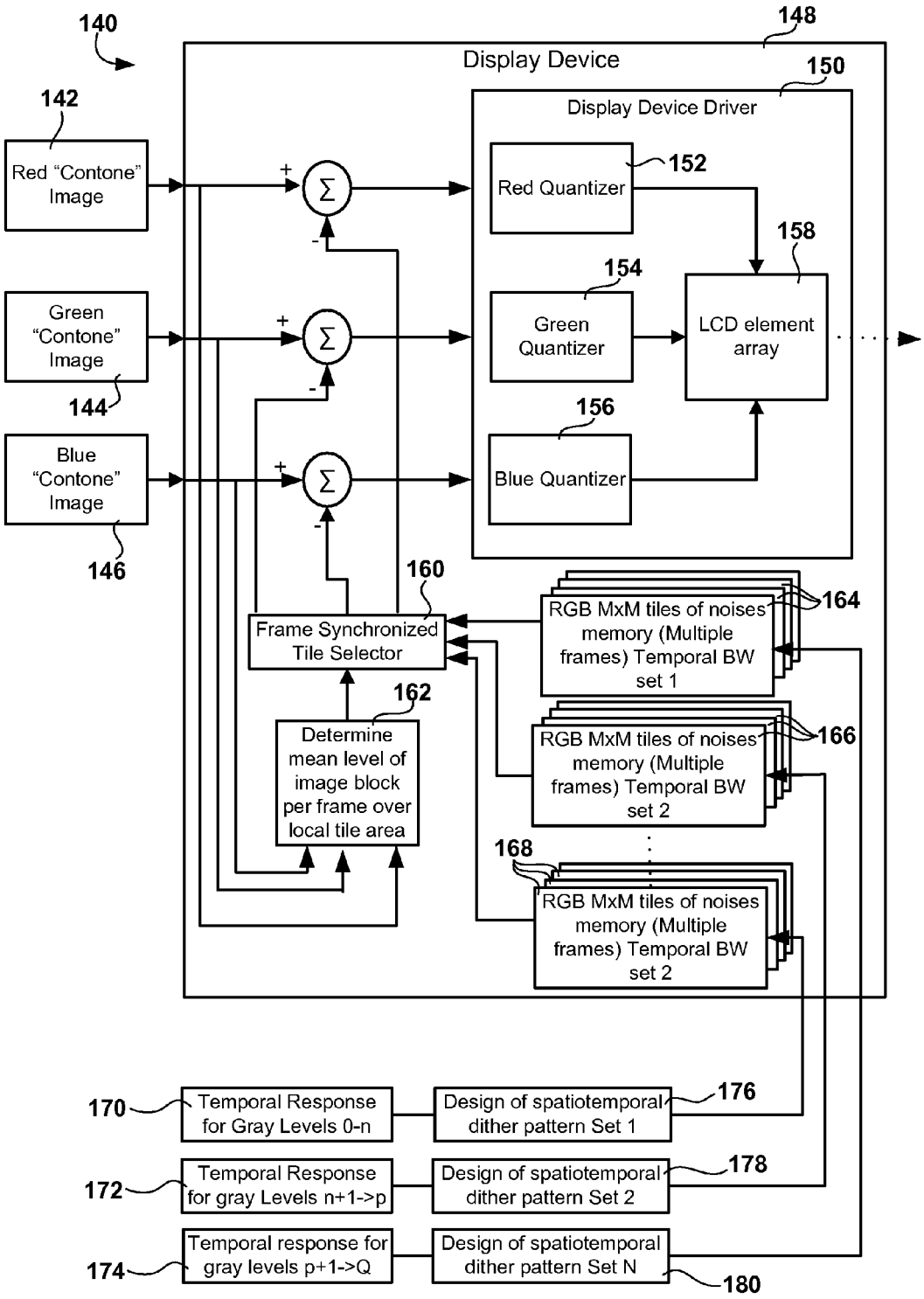
FIG. 11 is a diagram showing a system that employs multiple, gray-level-dependent dither tile sets.

FIG. 11 shows a block diagram depicting some embodiments of the present invention. In these embodiments, multiple dither pattern structures or arrays 164, 166 & 168 are created and/or used. Prior to application of the dither pattern tiles, the dither pattern structures 164, 166 & 168 are created and stored. Pattern creation starts with division of the luminance spectrum into finite ranges 170, 172 & 174. For each of these ranges 170, 172 & 174 a different set or array of dither patterns is designed and generated 176, 178 & 180. These dither pattern sets or arrays may vary in their temporal bandwidth or lower temporal frequency cutoff as well as other characteristics. These dither pattern sets or arrays may be generated by filtering noise to the pattern specification, by dynamic creation of the pattern or by other methods. Once the pattern sets or arrays are generated, they may be stored for application to an image.

In some embodiments, dither pattern sets or arrays may be stored 164, 166 & 168 in a display device for application therein.

Dither pattern sets may be applied to a monochrome images as well as color images. In color image embodiments, an image may be divided according to color channels 142, 144 & 146. In an exemplary embodiment, shown in FIG. 11, the color channels correspond to the red, green and blue channels of an RGB display, however, other color combinations may be used.

Each color channel image frame 142, 144 & 146 is combined with a dither pattern tile prior to quantization; however, the specific dither pattern tile set selected for a tile location in the frame is dependent on the luminance levels in the image frame where the dither pattern tile is applied. For example, if the luminance levels at a particular tile location fall into a first category or range 170, a dither pattern set 168 appropriate for that range will be selected and applied by a tile selector 160. If the luminance values at a second location fall into a second category or range 172, another dither pattern set 166 may be selected by the tile selector 160.

In some of these embodiments, a series of dither array sequences 164, 166 & 168 may be stored in memory in the display, and may be switched or selected based on the mean luminance gray level of the image corresponding to the tile's position. The luminance levels for a particular location in an image may be determined by a number of methods. The mean luminance gray level of a tile area may be used, however other luminance data may be used both in the design of the dither pattern sets and in the selection of the sets during application thereof. To avoid boundary effect associated with switching from one set of dither patterns to another, a transition region can be used to blend the two sets of dither patterns. For an example, if the transition level between dither patterns set 1 and set 2 is at mean luminance level 64, instead of switching from set 1 to set 2 at 64, the contribution of set 2 is gradually blended to set 1, starting at, 60, and ending at 68.

Once the dither pattern sets are applied to the image, each color channel is quantized 152, 154 & 156. Further processing may also occur. Eventually, the quantized information is assigned to a display element and displayed to a user 158.

Generation of Dither Spectrum

Embodiments of the present invention comprise methods and systems for generation of dither spectra. These dither pattern arrays, sets or structures can be generated in several ways. In some embodiments a white spatiotemporal spectra (i.e., white up to the spatial and temporal Nyquist frequencies) can be filtered to generate a suitable set of structures. In other embodiments the set of dither patterns can be generated by array filling using negative spatio-temporal-chromatic feedback.

In some embodiments that employ filtering of a spatiotemporal white spectrum, the starting point may be a 3-D image array, whose dimensions are horizontal spatial (pixels), vertical spatial (pixels), and temporal (frames), that is filled with a white spectrum. In some of these embodiments, the spectrum may originate from a noise that is first spatially filtered in each frame by a filter that approximates the inverse of the spatial CSF of the visual system (i.e., converted to a low-pass form as described in S. Daly (1993) Chapter 17 in Digital Images and Human Vision, ed., by A. B. Watson, MIT Press; incorporated herein by reference). Then the result is temporally filtered with the inverse of the product of the LCD temporal MTF and the temporal CSF of the visual system. The LCD temporal MTF may be overall nonlinear, but for small amplitudes it is approximately linear and its shape changes as a function of gray level (as shown in the diagonal regions of FIGS. 5 and 6). The LCD temporal MTF may be calculated from the edge response using usual line spread function (LSF) calculations. Approximations can be used for each of these filters, and Gaussian filters are a good $1^{st}$ order approximation.

Dither pattern arrays can also be generated by array filling with negative spatio-temporal-chromatic feedback. In some embodiments, a repellent function can be used to sequentially assign dither values to locations that will result in the desired pattern. Based on the size of the dither array, each gray level occurs a fixed number of times in the tile, resulting in a uniform pdf, as desired. Then the possible positions for each gray level are assigned based on the resulting arrays visibility using a visual error function. The visual error function is based on the spatiotemporal CSF model, typically, a CSF-weighted MSE.

Embodiments of the present invention comprise monochrome and color methods and systems. In color applications, some dither pattern arrays may be generated using three independent spatiotemporal arrays whose luminance is de-correlated across the arrays. This is an attempt to have the RGB array be isoluminant.

Further embodiments of the present invention comprise dither patterns that are generated real-time. In some of these embodiments, the local gray level parameters may control the dither generation process. In these embodiments, the temporal bandwidth may be changed in relation to the gray level parameter. In some instances, the lower bound of the temporal bandwidth and the variance may be allowed to change accordingly.

Embodiments of the present invention may comprise any number of dither pattern sets and any number of gray level ranges that correspond to these sets. In a simple embodiment, only two spatiotemporal noise sets are used. One set is used for the lighter range of gray levels and another is used for the dark range. The one used for the dark range has a lower temporal bandwidth, and a higher variance.

In some embodiments, color arrays may be generated by starting with multiple, independent arrays. Then these are applied to opponent color signals, and transformed via a matrix from having an achromatic, and two chromatic signals (such as L*, A*, and B*, or Y, U, and V) into a 3-channel RGB signal.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A method for adaptive processing of a digital image, said method comprising:

a) receiving a digital image at a computing device;

b) designating a tile location in said image for application of a dither pattern tile;

c) determining a mean luminance gray level for said tile location, with said computing device;

d) selecting a first dither pattern tile set from a plurality of dither pattern tile sets, with said computing device, wherein said selecting is based on said mean luminance gray level and said dither pattern tiles differ in temporal frequency bandwidth.

2. A method as described in claim 1 wherein said first dither pattern tile set comprises a first upper horizontal spatial frequency bound, a first lower horizontal frequency bound, a first upper vertical spatial frequency bound, a first lower vertical spatial frequency bound, a first upper temporal frequency bound and a first lower temporal frequency bound and other dither pattern tile sets in said plurality of dither pattern tile sets have varying lower temporal frequency bounds.

3. A method as described in claim 1 wherein said plurality of dither pattern tile sets are spatio-temporal dither pattern tile sets.

4. A method as described in claim 1 wherein said digital image is an individual color channel of a color digital image.

5. A method for adaptive processing of a digital image, said method comprising:

a) establishing a first multi-dimensional array of dither pattern tiles, with a computing device, said array comprising a first lower temporal frequency bound;

b) establishing a second multi-dimensional array of dither pattern tiles, with said computing device, said array comprising a second lower temporal frequency bound, wherein said second lower temporal frequency bound is lower than said first lower temporal frequency bound; and c) associating said first multi-dimensional array of dither pattern tiles with a first range of local luminance characteristic values; and d) associating said second multi-dimensional array of dither pattern tiles with a second range of local luminance characteristic values;

e) determining a local luminance characteristic for a plurality of tile block locations, with said computing device;

f) selecting a dither pattern tile from said first multi-dimensional array of dither pattern tiles for application on at least one of said tile block locations when said at least one of said tile block locations has a local luminance characteristic value that falls within said first range; and g) selecting a dither pattern tile from said second multi-dimensional array of dither pattern tiles for application on at least one of said tile block locations when said at least one of said tile block locations has a local luminance characteristic value that falls within said second range, wherein said selecting and said application are performed by said computing device.

6. A method as described in claim 5 wherein said first multi-dimensional array of dither pattern tiles further comprises a first upper horizontal spatial frequency bound, a first lower horizontal frequency bound, a first upper vertical spatial frequency bound, a first lower vertical spatial frequency bound and a first upper temporal frequency bound and said second multi-dimensional array of dither pattern tiles further comprises a second upper horizontal spatial frequency bound, a second lower horizontal frequency bound, a second upper vertical spatial frequency bound, a second lower vertical spatial frequency bound and a second upper temporal frequency bound.

7. A method as described in claim 5 wherein said second range of luminance characteristic values is lighter than said first range of luminance characteristic values.

8. A system for adaptive processing of a digital image, said system comprising:

a) a first multi-dimensional array of dither pattern tiles, said array comprising a first lower temporal frequency bound, wherein said first multi-dimensional array is associated with a first range of a mean luminance gray level;

b) a second multi-dimensional array of dither pattern tiles, said array comprising a second lower temporal frequency bound, wherein said second lower temporal frequency bound is lower than said first lower temporal frequency bound, wherein said second multi-dimensional array is associated with a second range of said mean luminance gray level; and c) a selector for selecting between said first array and said second array based on the mean luminance gray level value for a location in said digital image.

9. A system as described in claim 8 wherein said first multi-dimensional array of dither pattern tiles further comprises a first upper horizontal spatial frequency bound, a first lower horizontal frequency bound, a first upper vertical spatial frequency bound, a first lower vertical spatial frequency bound and a first upper temporal frequency bound and said second multi-dimensional array of dither pattern tiles further comprises a second upper horizontal spatial frequency bound, a second lower horizontal frequency bound, a second upper vertical spatial frequency bound, a second lower vertical spatial frequency bound and a second upper temporal frequency bound.

* * * * *